US006328610B1

(12) United States Patent
Chang

(10) Patent No.: US 6,328,610 B1
(45) Date of Patent: Dec. 11, 2001

(54) TERMINAL AND TERMINAL HOLDER MOUNTING ARRANGEMENT FOR AN ELECTRIC CONNECTOR

(75) Inventor: Chih-Kai Chang, Sanchung (TW)

(73) Assignee: Speed Tech Corporation, Taoyuan Hsien (TW)

( * ) Notice: Subject to any disclaimer, the term of this patent is extended or adjusted under 35 U.S.C. 154(b) by 0 days.

(21) Appl. No.: 09/660,932

(22) Filed: Sep. 13, 2000

(30) Foreign Application Priority Data

May 23, 2000 (TW) ..... 089109898

(51) Int. Cl.[7] ..... H01R 24/00
(52) U.S. Cl. ..... 439/676; 439/439; 439/701
(58) Field of Search ..... 439/676, 941, 439/344, 79, 862

(56) References Cited

U.S. PATENT DOCUMENTS 6,093,060 * 7/2000 Wiebking et al. ..... 439/676

* cited by examiner

*Primary Examiner*—Gary Paumen
*Assistant Examiner*—Ross Gushi
(74) *Attorney, Agent, or Firm*—Bacon & Thomas

(57) ABSTRACT

A terminal and terminal holder mounting arrangement includes a terminal holder, and a plurality of terminals installed in the terminal holder and adapted for mounting on a circuit board to receive an electric connector, the terminal holder having a front body, a rear body, and an opening transversely disposed on the middle between the front body and the rear body, the terminals being inserted through the opening of the terminal holder and respective terminal channels at the top side of the front body of and respective positioning grooves at the bottom side of the rear body, each terminal having one end terminating in a front end pin portion extended over the front side of the front body and bent downwards, an opposite end terminating in a rear end pin portion extended over the rear side of the rear body and bent upwards, and an expanded locating block positioned in locating grooves in the terminal channels.

5 Claims, 6 Drawing Sheets

TERMINAL AND TERMINAL HOLDER MOUNTING ARRANGEMENT FOR AN ELECTRIC CONNECTOR

BACKGROUND OF THE INVENTION

The present invention relates to a terminal and terminal holder mounting arrangement for an electric connector, and more particularly to such a terminal and terminal holder mounting arrangement, which simplifies the assembly procedure of the electric connector, and reduces its manufacturing cost.

Various electric terminal and terminal holder mounting designs have been disclosed. FIG. 10 shows a prior art design. According to this design, a special tool must be used to bend the terminals to the desired shape. After installation of the terminals in the terminal holders, partition plates must be installed to prevent contact between terminals.

SUMMARY OF THE INVENTION

It is one object of the present invention to provide a terminal and terminal holder mounting arrangement for an electric connector, which simplifies the assembly process of the electric connector. It is another object of the present invention to provide a terminal and terminal holder mounting arrangement for an electric connector, which greatly reduces the manufacturing cost of the electric connector. To achieve these and other objects of the present invention and according to one aspect of the present invention, there is provided a terminal and terminal holder mounting arrangement, which comprises a terminal holder injection molded from plastics, and a plurality of terminals installed in the terminal holder and adapted for mounting on a circuit board to receive an electric connector. The terminal holder comprises a front body, a rear body, and an opening transversely disposed on the middle between the front body and the rear body. The terminals are inserted through the opening of the terminal holder and respective terminal channels at the top side of the front body of and respective positioning grooves at the bottom side of the rear body, each having one end terminating in a front end pin portion extended over the front side of the front body and bent downwards, an opposite end terminating in a rear end pin portion extended over the rear side of the rear body and bent upwards, and an expanded locating block positioned in locating grooves in the terminal channels. According to another aspect of the present invention, the terminals are formed integral with a breakable material strip, which can be broken and separated from the terminals after the terminals had been positioned in the terminal holder. According to still another aspect of the present invention, the terminals each have end pin portions at two distal ends, and two bending portions extended from the end pin portions toward each other for enabling the end pin portions to be bent to the desired direction by hand without the use of a hand tool.

DETAILED DESCRIPTION OF THE PREFERRED EMBODIMENT

Referring to FIGS. from 1 through 3, a terminal and terminal holder mounting arrangement in accordance with the present invention comprises a terminal module 1, and a terminal holder 2.

Figure 1:
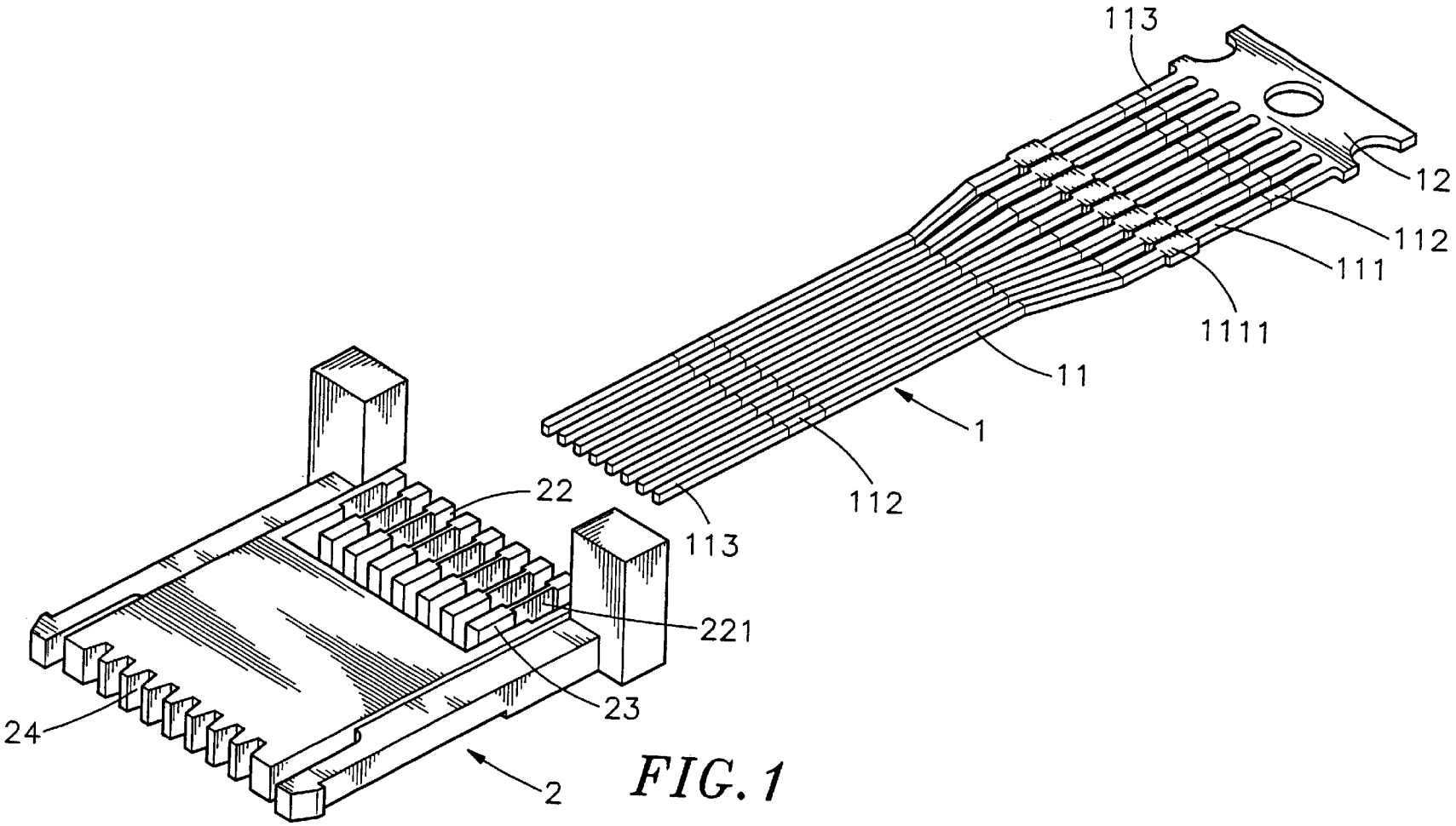
FIG. 1 is an exploded view of the present invention.

Referring to FIG. 1 again, the terminal module 1 comprises a material strip 12, and a plurality of terminals respectively extended from one side of the material strip 12 in same direction. The terminals 11 each comprise a positioning unit 111, two end pin portions 113 at two distal ends, and two bending portions 112 respectively connected between two distal ends of the positioning unit 111 and the end pin portions 113. The positioning unit 111 has an expanded locating block 1111.

Figure 2:
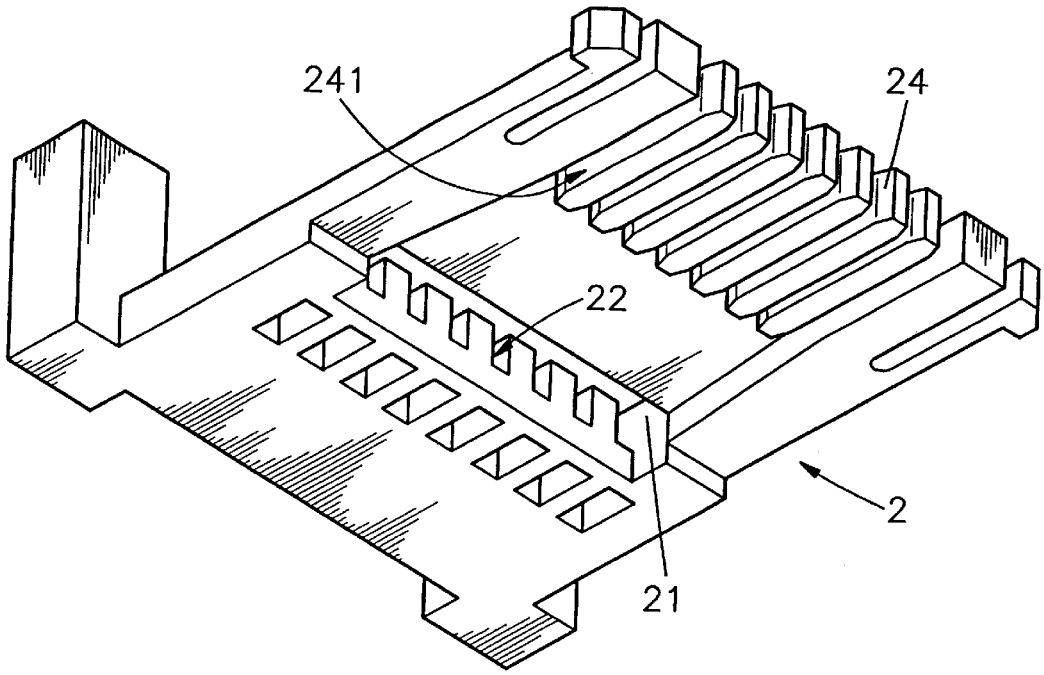
FIG. 2 is an oblique bottom view of the terminal holder shown in FIG. 1.
Figure 3:
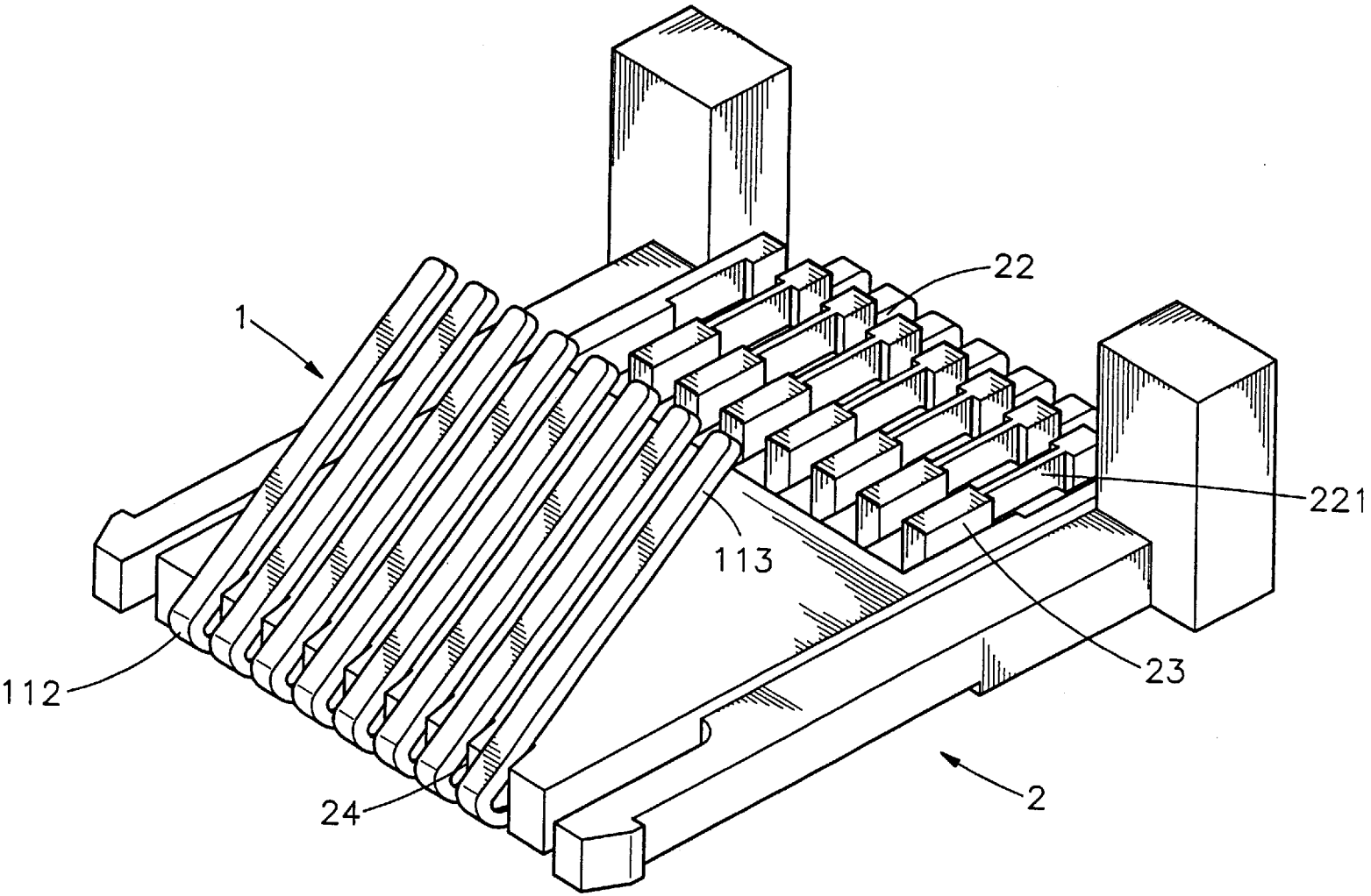
FIG. 3 is a perspective assembly view of the present invention.

Referring to FIGS. 2 and 3 again, the terminal holder 2 is injection-molded from plastics, comprising an opening 21 transversely disposed on the middle, which separates the terminal holder 2 into a front body and a rear body, a plurality of channels 22 arranged in parallel at the front body, a plurality of positioning rails 24 formed integral with the rear body and protruded over the rear side of the rear body, and a plurality of positioning grooves 241 arranged in parallel at the bottom side of the rear body portion and separated by the positioning rails 24. The partition wall between each two adjacent channels 22 has a rear end terminating in a stop block portion 23 disposed adjacent to the opening 21 and a necking portion 231 at the bottom side of the stop block portion 23, and two locating grooves 221 symmetrically disposed at two opposite sides and respectively forwardly extended from the stop block portion 23.

Figure 4:
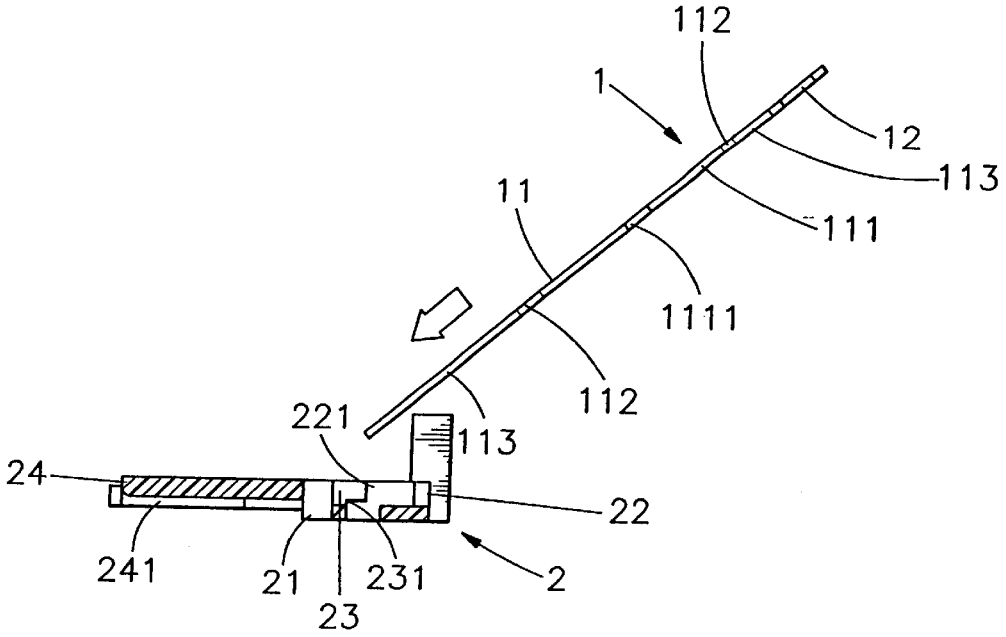
FIG. 4 is a schematic drawing showing the assembly procedure of the present invention (I).
Figure 5:
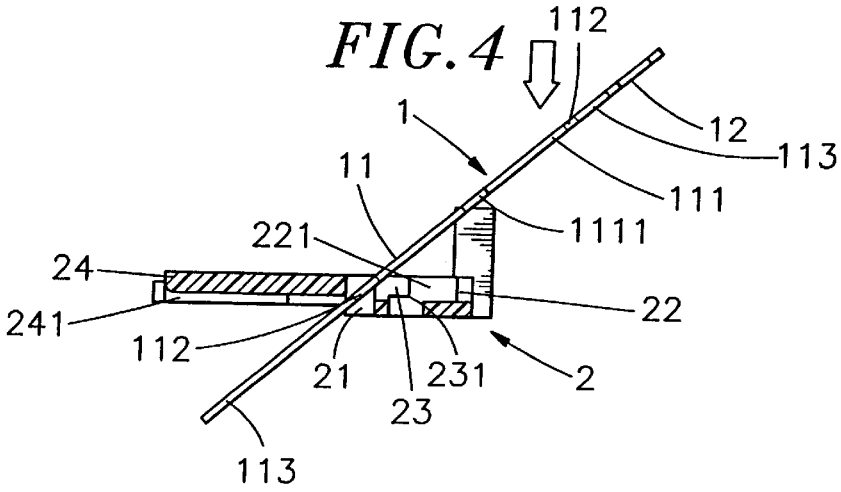
FIG. 5 is a schematic drawing showing the assembly procedure of the present invention (II).
Figure 6:
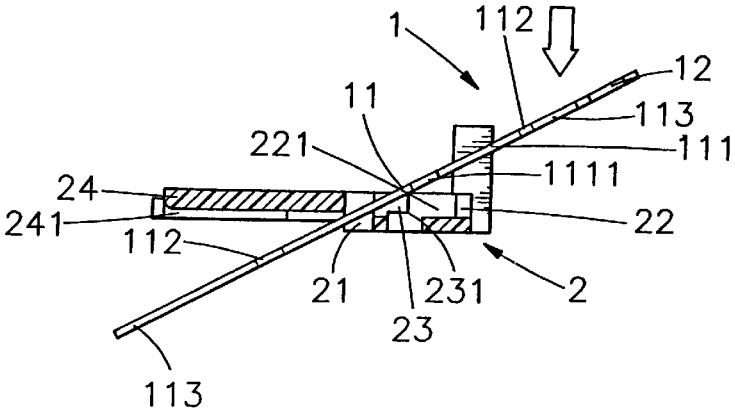
FIG. 6 is a schematic drawing showing the assembly procedure of the present invention (III).
Figure 7:
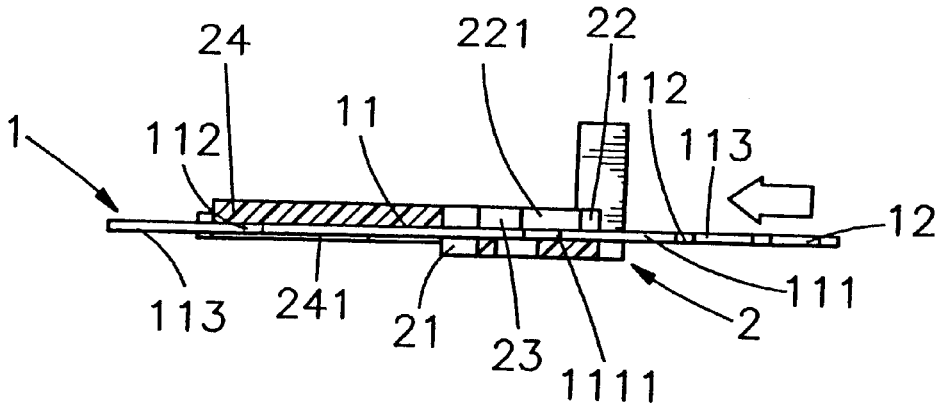
FIG. 7 is a schematic drawing showing the assembly procedure of the present invention (IV).
Figure 8:
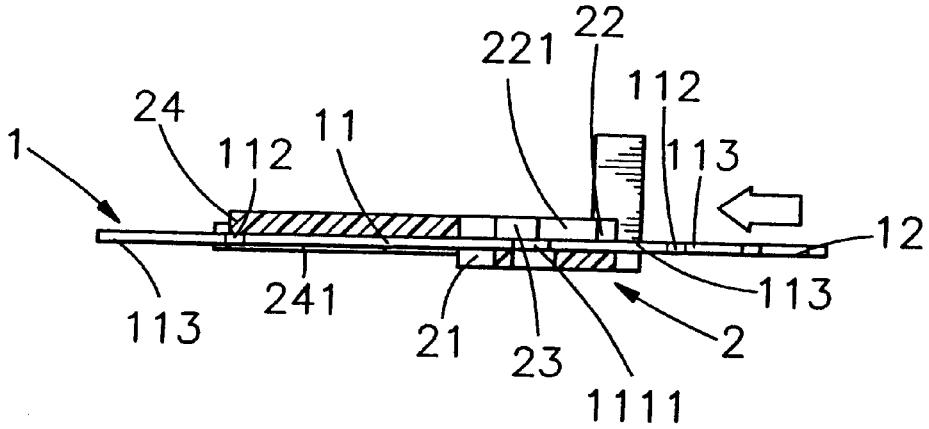
FIG. 8 is a schematic drawing showing the assembly procedure of the present invention (V).
Figure 9:
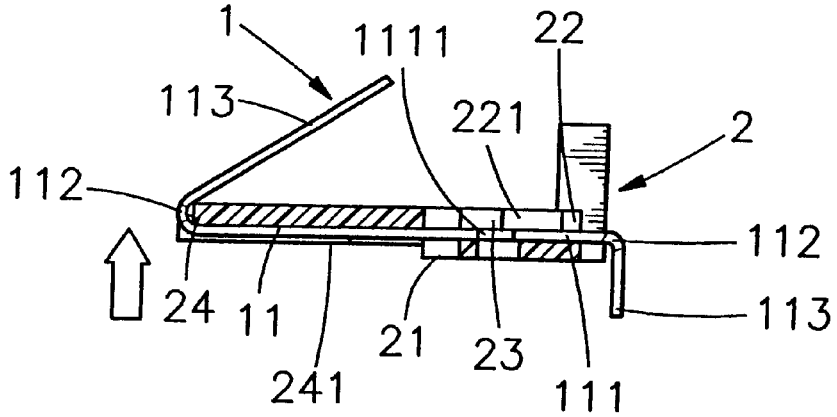
FIG. 9 is a schematic drawing showing the assembly procedure of the present invention (VI).
Figure 10:
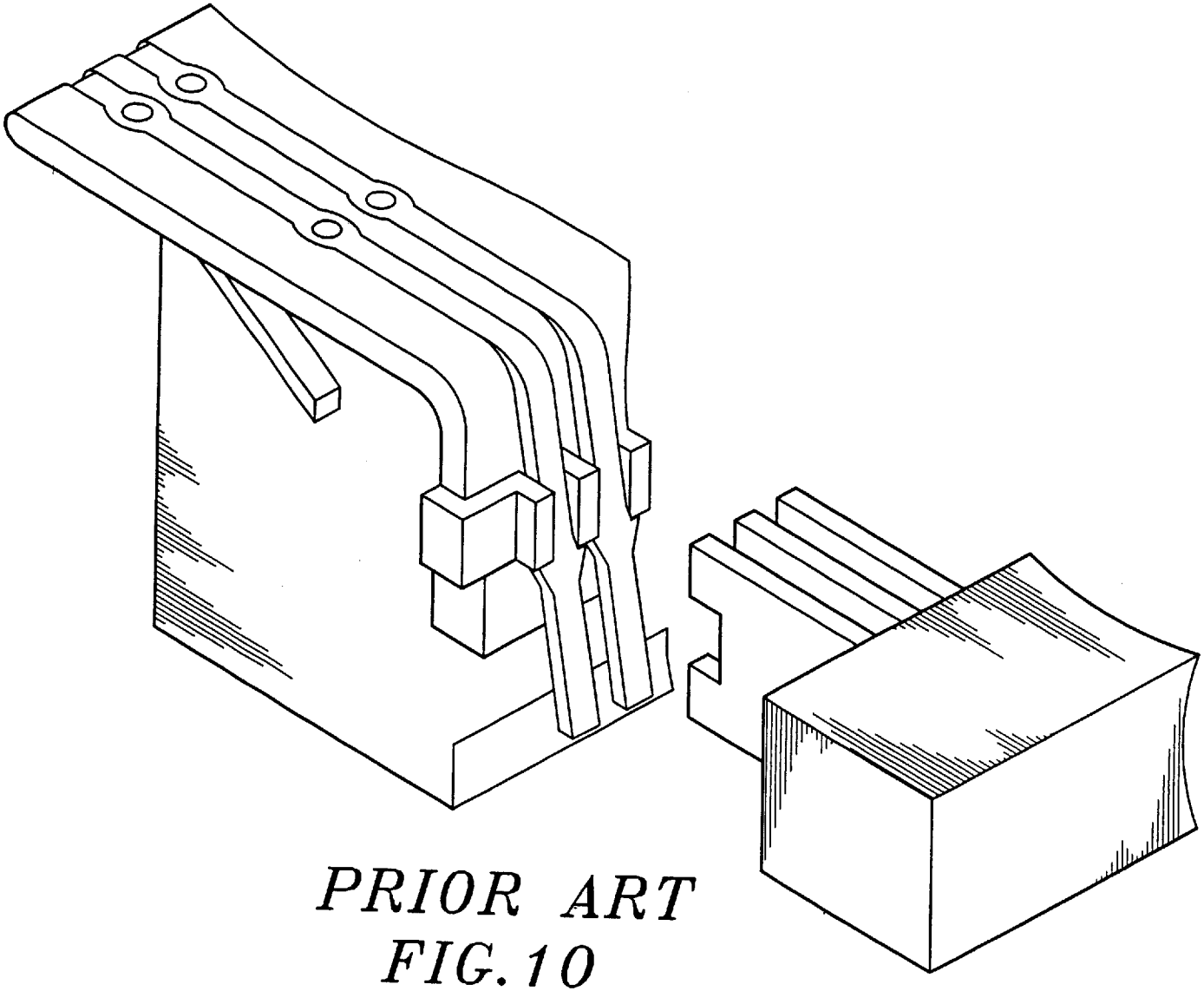
PRIOR ART FIG. 10
FIG. 10 is an exploded view of the prior art.

Referring to FIGS. from 4 through 9 and FIGS. from 1 through 3 again, the remote end pin portions 113 of the terminals 11 of the terminal module 1 are respectively obliquely inserted through the opening 21 of the terminal holder 2 from the top side toward the bottom side (see FIG. 5), and then the material strip 12 is turned downwards (see FIG. 6) to force the expanded locating blocks 111 of the terminals 11 into the locating grooves 221 in each channel 22 and a part of each terminal 11 into the positioning grooves 241 (see FIGS. 2 and 7), and then the material strip 12 is pushed forwards toward the terminal holder 2 to stop the expanded locating blocks 111 of the terminals 11 at the necking portions 231 at the bottom side of the stop block portions 23 in the channels 22 (see FIGS. 4 and 8), and then the material strip 12 is broken and separated from the terminals 11, and then end pin portions 113 at the front side of the terminals 11 and the end pin portions 113 at the rear side of the terminals 11 are respectively bent downwards and upwards for further connection to the matching electric connector and the matching circuit board.

While only one embodiment of the present invention has been shown and described, it will be understood that various modifications and changes could be made thereunto without departing the spirit and scope of the invention disclosed.

What the invention claimed is:

1. A terminal and terminal holder mounting arrangement comprising:

a terminal holder, said terminal holder comprising a front body, a rear body, and an opening transversely disposed on the middle between said front body and said rear body, said front body having a top side adapted to receive terminals, said rear body having a bottom side adapted to receive terminals; and a plurality of terminals respectively inserted through the opening of said terminal holder and arranged in parallel and attached to the top side of said front body of said terminal holder and the bottom side of said rear body of said terminal holder, said terminals each having one end terminating in a front end pin portion extended over a front side of said front body of said terminal holder remote from said rear body of said terminal holder and bent downwards, and an opposite end terminating in a rear end pin portion extended over a rear side of said rear body of said terminal holder remote from said front body of said terminal holder and bent upwards;

wherein said front body of said terminal holder comprises a plurality of terminal channels arranged in parallel and a plurality of locating grooves bilaterally disposed in each of said terminal channels, and said terminals are respectively inserted through the terminal channels of said terminal holder, each comprising an expanded locating block respectively engaged into the locating grooves in each of said terminal channels.

2. The terminal and terminal holder mounting arrangement of claim 1 wherein said front body of said terminal holder comprises a plurality of necking portions respectively disposed corresponding to said terminal channels and adapted to stop the expanded stop blocks of said terminal channels in said terminal channels.

3. The terminal and terminal holder mounting arrangement of claim 2 wherein said terminal holder comprises a plurality of positioning rails respectively formed integral with said rear body and protruded over the rear side of said rear body, and a plurality of positioning grooves arranged in parallel at the bottom side of said rear body portion and separated by said positioning rails and adapted to receive said terminals respectively.

4. The terminal and terminal holder mounting arrangement of claim 3 wherein said terminals each comprise a bending portions respectively connected to the respective front end pin portion and the respective rear end pin portions between and respectively supported on the front side of said front body of said terminal holder and the rear side of said rear body of said terminal holder.

5. The terminal and terminal holder mounting arrangement of claim 4 wherein the front end pin portions of said terminals are respectively connected to a material strip that can be broken and separated from said terminals after said terminals had been installed in said terminal holder.

* * * * *